US005755603A

United States Patent [19]

Kumita

[11] Patent Number: 5,755,603

[45] Date of Patent: May 26, 1998

[54] TILT LOCKING MECHANISM FOR OUTBOARD MOTOR

[75] Inventor: Atsushi Kumita, Hamamatsu, Japan

[73] Assignee: Sanshin Kogyo Kabushiki Kaisha, Hamamatsu, Japan

[21] Appl. No.: 635,722

[22] Filed: Apr. 22, 1996

[30] Foreign Application Priority Data

Apr. 21, 1995 [JP] Japan ..... P13122

[51] Int. Cl.[6] ..... B63H 5/125

[52] U.S. Cl. ..... 440/55

[58] Field of Search ..... 440/55, 56, 63, 440/53; 248/643

[56] References Cited

U.S. PATENT DOCUMENTS 4,759,733 7/1988 Nishimura ..... 440/55

4,925,410 5/1990 Boda ..... 440/55

*Primary Examiner*—Sherman Basinger

*Attorney, Agent, or Firm*—Knobbe, Martens, Olson & Bear LLP

[57] ABSTRACT

A tilting assembly for an outboard motor drive unit includes a clamp bracket having a holder portion. A swivel bracket is pivotally mounted to the clamp bracket for tilting movement between a desired tilted-down and tilted-up position. A holder arm is provided for supporting the swivel bracket and drive unit in the desired tilted-up position in the holder portion. The holder arm is pivotally mounted to the swivel bracket and selectively engageable with the holder portion for setting the desired tilted-up position. A tilt lock lever connects the swivel bracket to the clamp bracket. The tilt lock lever includes a support block for providing additional support for the swivel bracket in holding the outboard drive unit in the desired tilted-up position.

10 Claims, 3 Drawing Sheets

TILT LOCKING MECHANISM FOR OUTBOARD MOTOR

BACKGROUND OF THE INVENTION

This invention relates generally to a tilting assembly for an outboard drive unit, and more particularly, to an improved tilt locking assembly for an outboard drive unit that includes additional support for holding a swivel bracket and outboard drive unit in a tilted-up position.

An outboard drive unit, which may be comprised of an outboard motor or the outboard drive portion of an inboard/outboard drive, typically employs an arrangement for supporting the drive unit for pivotal movement about a generally horizontally extending tilt axis. This pivotal movement is provided to adjust the trim of the drive unit to suit varied running conditions and to tilt the drive unit to an out-of-the-water position for servicing, storage, trailering, or the like.

As mentioned above, it is advantageous to tilt and secure an outboard drive unit in a tilted-up position for a variety of reasons. An example of a typical tilting assembly that allows the drive unit to be raised and locked in a tilted-up position employs a swivel bracket connected to a drive unit for supporting the drive unit. The swivel bracket is pivotally mounted to a clamp bracket for tilt and trim movement of the drive unit. A holder arm is pivotally mounted to the swivel bracket and is engageable with a series of notches formed in the clamp bracket for supporting the outboard drive unit in a partially or fully tilted-up state. These notches are designed to prevent accidental disengagement of the holder arm from the clamp bracket.

In this type of assembly, all of the weight of the drive unit is supported at two points, first, where the swivel bracket is pivotally mounted to the clamp bracket, and second, where the holder arm is pivotally mounted to the swivel bracket. Providing load concentrations in the swivel bracket at these points could, in an extreme case, lead to eventual problems in the latching assembly. One potential problem is the possibility of structural failure in the swivel bracket caused by the load concentration over time at the point where the holder arm is pivotally connected to the swivel bracket. This is a more likely problem where a user leaves the drive unit in a tilted-up position for long periods of time, such as during winter storage. A possibility of structural failure also exists in the holder arm and the notches engaged by the holder arm since these components are subject to the same loads as the pivotal connection between the holder arm and swivel bracket.

It is therefore a principal object of the present invention to provide an improved tilt lock assembly for an outboard drive unit that includes an additional support for distributing the load carried by the swivel bracket in order to prevent structural failure in the tilting assembly.

Another potential problem is the accidental falling of the swivel bracket and drive unit from the tilted-up position. This could occur from structural failure in the tilting assembly, as mentioned above, or from disengagement of the holder arm from the notches in the clamp bracket caused from a sudden upward movement of the swivel bracket and drive unit. Although the notches are designed to prevent accidental disengagement of the holder arm, a sudden upward movement of the drive unit caused from a wave hitting a boat or a boat trailer hitting a bump in a road might cause the holder arm to accidentally disengage the holder portions.

It is therefore a further object of the present invention to provide an improved tilt lock assembly for an outboard drive unit that includes additional support that prevents the swivel bracket and drive unit from accidentally falling from the tilted-up position if the holder arm becomes disengaged from the notches of the clamp bracket or if the structure of part of the tilting assembly fails.

SUMMARY OF THE INVENTION

As indicated by the above discussion of a typical latching assembly for an outboard drive unit, a need exists for providing additional support for the swivel bracket. In accordance with the present invention, a tilting assembly for an outboard motor drive unit comprises a clamp bracket having a holder portion with a set of notches. The clamp bracket is adapted to be affixed to a transom of an associated watercraft. A swivel bracket is connected to the outboard motor drive unit for supporting the drive unit. The swivel bracket is pivotally mounted to the clamp bracket for tilting movement between a desired tilted-down and tilted-up position. A holder arm is provided for supporting the swivel bracket and drive unit in the desired tilted-up position in the notches of the clamp bracket. The holder arm is pivotally mounted to the swivel bracket and selectively engageable with the notches for setting the desired tilted-up position. The tilting assembly is equipped with a tilt lock lever between the swivel bracket and clamp bracket. The tilt lock lever includes a support block for providing additional support for the swivel bracket in holding up the outboard drive unit in the desired tilted-up position and prevents the swivel bracket and drive unit from accidentally falling from this position.

DETAILED DESCRIPTION OF THE PREFERRED EMBODIMENTS OF THE INVENTION

Figure 1:
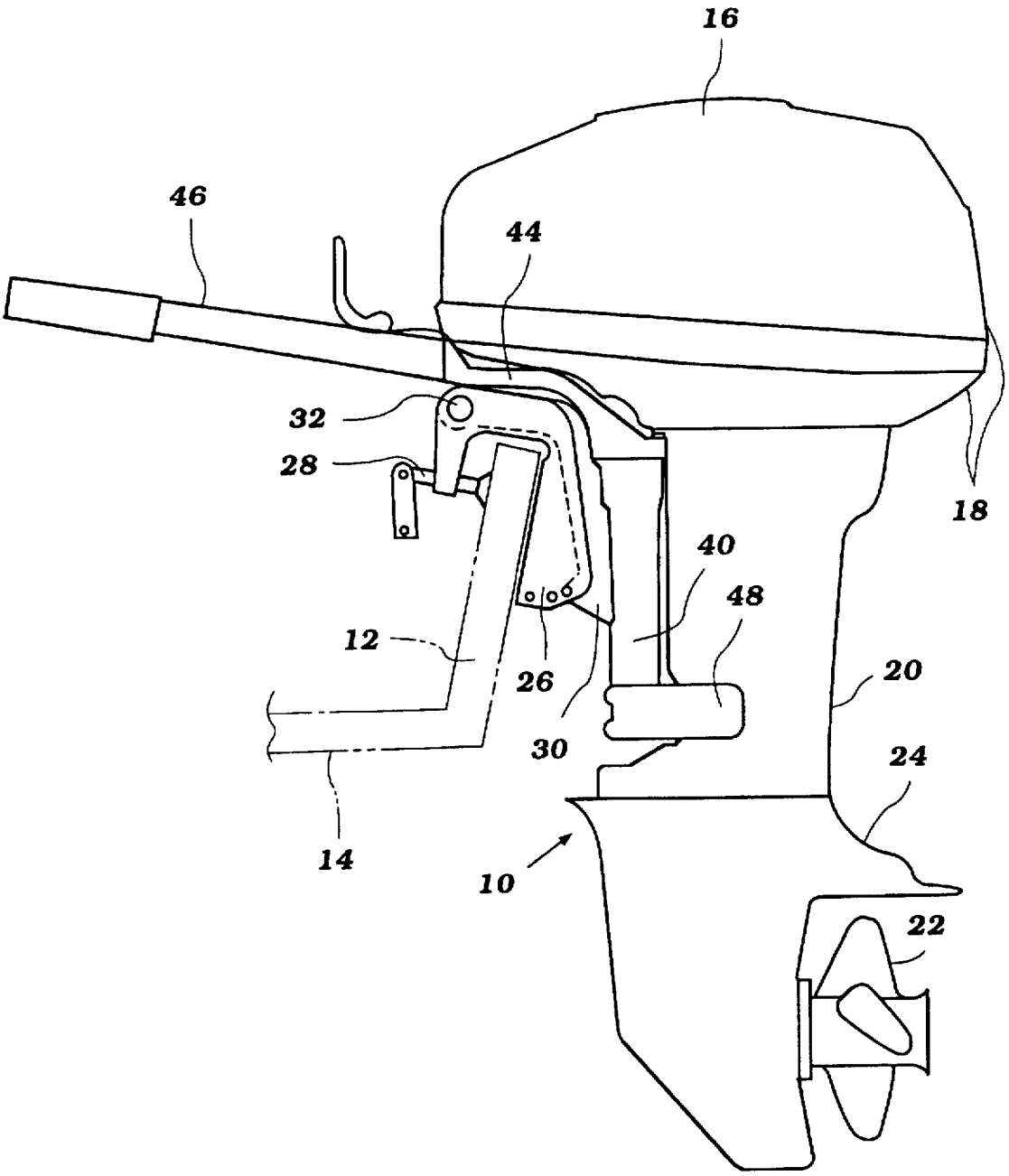
FIG. 1 is a side elevational view of an outboard motor attached to the transom of an associated watercraft shown in the tilted-down position.

Referring first to FIG. 1, an outboard drive unit in the form of an outboard motor, indicated generally by the reference numeral 10, is mounted on the transom 12 of a hull 14 of an associated watercraft. Although the invention is described in conjunction with an outboard motor 10, it is to be understood that the invention may equally as well be practiced with the outboard drive portion of an inboard/outboard drive. However, the invention has particular utility in connection with an outboard motor.

The outboard motor 10 is comprised of a powerhead, indicated generally by the reference numeral 16, which includes an internal combustion engine (not shown) and a surrounding protective cowling, identified by the reference numeral 18. The engine, which may be of any conventional type, has an output shaft that drives a drive shaft journaled for rotation within a drive shaft housing 20 and which drives a propeller 22 of a lower unit 24 through a conventional forward/neutral/reverse transmission (not shown).

Figure 2:
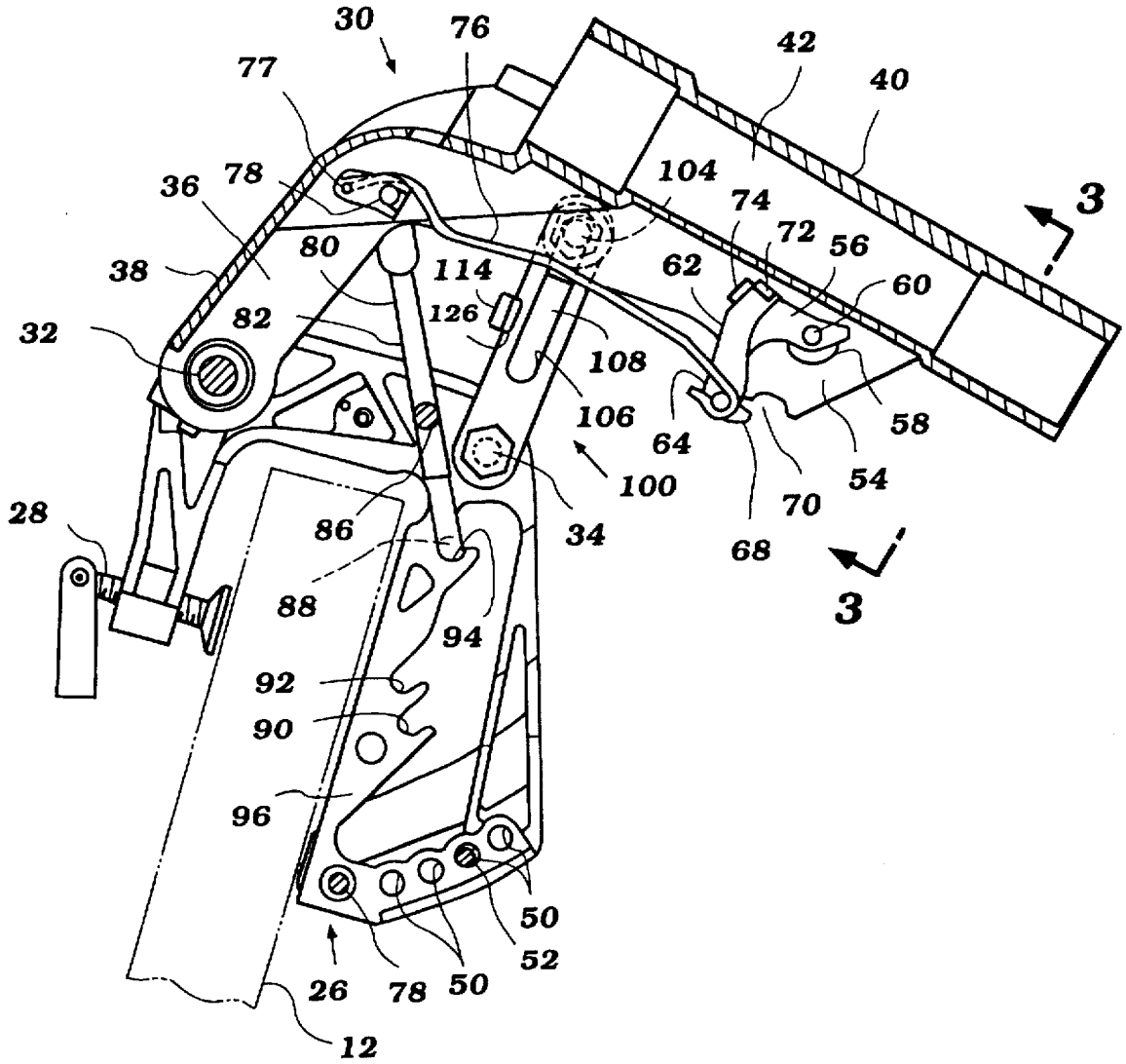
FIG. 2 is an enlarged side elevational view showing the tilt locking assembly of the present invention in cross section, with the swivel bracket in its tilted-up, locked position.

Referring to FIGS. 1 and 2, a clamp bracket 26 is mounted to the transom 12 through a clamp screw 28. A swivel bracket 30 is pivotally mounted to the clamp bracket 26 through a primary tilt shaft 32 and a secondary tilt shaft 34, described in more detail below, for tilt and trim adjustment of the outboard motor 10. The swivel bracket 30 is comprised of a swivel bracket arm 36 that includes a flange 38 extending along an upper part of the arm 36. A collar 40 is formed integral with the swivel bracket arm 36.

A steering shaft 42 is affixed to a steering bracket 44, which is in turn mounted to the drive shaft housing 20. The steering shaft 42 is journaled within the collar 40 of the swivel bracket 30 for steering of the outboard motor 10 about a generally vertically extending steering axis. A tiller 46 is connected to the steering bracket 44 for controlling the steering of the outboard motor 10. The steering shaft 42 is connected to a lower part of the drive shaft housing 20 through a lower mount 48. The steering shaft 42 is connected to an upper part of the drive shaft housing through an upper mount (not shown) for steering of the outboard motor 10.

Referring to FIG. 2, the clamp bracket 26 has a series of trim apertures 50 extending transversely therethrough for receiving a stop pin or member 52 which is engageable with a projection 54 of the swivel bracket 30 for setting the tilted-down position of the swivel bracket 30 and outboard motor 10. Thus, the angle of the outboard motor 10 with respect to the transom 12 of the watercraft may be selectively varied by the operator in accordance with desired operating conditions by inserting the stop pin 52 in the appropriate aperture of the clamp bracket 26.

Releasable locking means are provided on the swivel bracket 30 for releasably locking or engaging the stop pin 52 to retain the swivel bracket 30 and outboard motor 10 in a selected tilted-down, position under normal running conditions of the motor 10 and to prevent the motor 10 from popping up when operating in reverse. The releasable locking means comprise a lever 56 which is pivotally mounted at one end to an extension 58 of the swivel bracket 30 by means of a pivot pin 60. A lock arm 62 is pivotally mounted to the lever 56 at a head 64 of the lock arm 62 by means a pin 66. The lock arm 62 includes a latch 68 that defines a recess 70 that is adapted to selectively engage the stop pin 52 so as to retain the swivel bracket 30 and motor 10 in a selected downward running position.

At the opposite end of the lock arm 62, a projection 72 extends laterally from the arm 62: A spring (not shown) connects the projection 72 to the swivel bracket for exerting an upward force on the projection 72, causing an upper surface of the lock arm 62 to forcibly bear against a tang 74 formed on lever 56 to hold the lock arm 62 in a locked position under normal forward running conditions. Another spring (not shown) may also be used to urge the lever 56 in a counterclockwise direction to further assist in retaining the swivel bracket 30 and outboard motor 10 in a tilted-down position, especially when the outboard motor 10 is in reverse.

Releasing means are provided for releasing the above-described locking means and comprise a release link 76 connected at its lower end to the pin 66 of the lock arm 62 and connected at its upper end to a lever 78. The upper end of the release link 76 extends through an aperture 79 in the lever 78 for connecting the end to the lever 78. The lever 78 is pivotally mounted to the swivel bracket 30 through the support shaft 84. An independent operating lever is mounted to the support shaft 84 for operating the lever 78. As the lever 78 is rotated in the counterclockwise direction, as shown in FIG. 2, the release link 76 causes the lock arm 62 and lever 56 to rotate so that the latch 68 disengages the stop pin 52.

A holding or supporting means are provided for holding the swivel bracket 30 and outboard motor 10 in a desired tilted-up position. The holding means comprise a holder arm 80 which includes a pair of generally L-shaped members 82 that are each pivotally mounted near opposite ends of a support shaft 84 for independent rotation with respect to the shaft 84. These L-shaped members 82 are interconnected by a rod 86 so that they will pivot as a unit. Each of these L-shaped members 82 includes a horizontal segment 88 which extends from the holder arm 80 outwardly in an opposite direction from its counterpart. These horizontal segments 88 are selectively engageable with a series of notched holder portions, or notches, 90, 92, and 94, formed in rearwardly extending plate portions 96 of the clamp bracket 26. The notches 90–94 are designed to prevent the horizontal segments 88 from accidentally disengaging the notches 90–94. The rearwardly extending plate portions 96 are connected to the rest of the clamp bracket 26 through threaded fasteners 98.

Biasing means are provided for biasing the holder arm 80 towards or away from the notched portions 90–94 of the clamp bracket 26. The biasing means take the form of an over-the-center spring (not shown) connecting the rod 86 of the holder arm 80 to the lever 78 for urging the holder arm 80 either away from or towards the notched portions 90–94. The biasing means are operably associated with the releasing means through the lever 78 so that when the lever 78 is rotated counter-clockwise and the lock arm 62 goes from engaging to disengaging stop pin 52, the biasing means go from biasing the holder arm 80 away from the notched portions 90–94 to biasing the holder arm 80 towards the notched portions 90–94. Thus, when the motor 10 is raised to a tilted-up position, the holder arm 80 is urged against and rises along the notched portions 90–94. To engage the holder arm 80, the motor 10 and swivel bracket 30 are tilted up to a point slightly above the selected notch 90–94 and then lowered slightly so that the horizontal segments 88 engage the selected notch 90–94 to hold the swivel bracket 30 and outboard motor 10 in a selected tilted-up position. Likewise, when lowering the swivel bracket 30 and outboard motor 10, the biasing means biases the holder arm 80 away from the notched portions 90–94 so that the holder arm 80 does not catch on the notched portions 90–94 in the clamped bracket 26.

Figure 3:
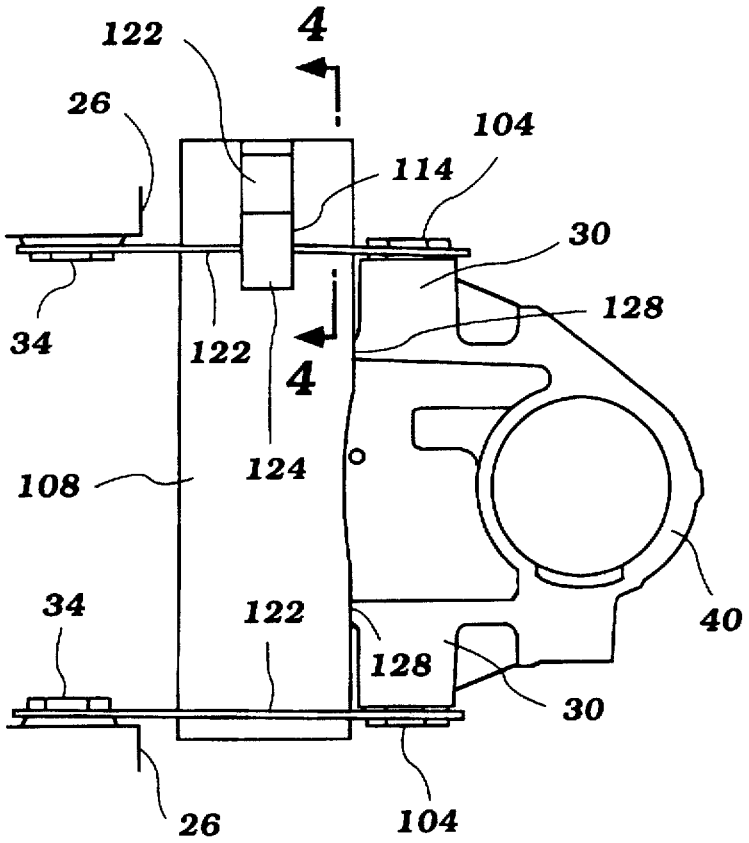
FIG. 3 is a lower cross-sectional view of the tilt locking assembly of the present invention taken along line 3—3 of FIG. 2.
Figure 4:
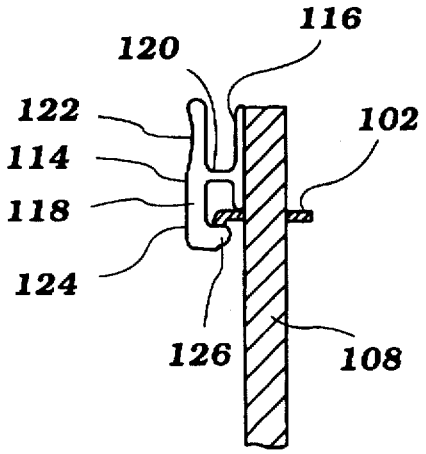
FIG. 4 is a cross-sectional view of part of the tilt locking assembly of the present invention taken along line 4—4 of FIG. 3.

Referring to FIGS. 2–4, the improved tilt locking assembly of the present invention will now be described. Additional supporting or holding means are provided for additionally supporting swivel bracket 30 and motor 10 in a desired tilted-up position. The additional supporting means comprise a tilt lock lever 100 connecting an intermediate part of the swivel bracket 30 to an upper part of the clamp bracket 26 for pivotal movement of the swivel bracket 30 and motor 10 about the secondary tilt shaft 34 in addition to the pivotal movement of the swivel bracket 30 and motor 10 about the primary tilt shaft 32. The tilt lock lever 100 is comprised of two parallel tilt lock arms 102 pivotally mounted at one end of the lever 100 to the clamp bracket 26 by the secondary tilt shaft 34 and pivotally mounted at an opposite end of the lever 100 to the swivel bracket 30 by the shaft 104. Shafts 34 and 104 are comprised of threaded fasteners.

The tilt lock lever 100 includes aligned elongated grooves 106 extending longitudinally in the arms 102. Shaft 104 and swivel bracket 30 are slidably disposed within elongated grooves 106. A support block 108 is inserted by an user transversely through the grooves 106 of the tilt lock lever 100. The support block 108 includes opposing faces, sides and ends. The support block 108 is restrained in a direction perpendicular to the faces by groove 106. The support block 108 slides within the elongated grooves 106 in the longitudinal direction of grooves 106. The block 108 is restrained at one side of the support block 108 by an end of the groove 106 closest to the secondary shaft 34 and at an opposite side of the support block 108 by the swivel bracket 30.

A fastener 114 prevents the support block 108 from sliding in a transverse, or lateral, direction relative to the tilt lock lever 100. Fastener 114 includes a base 116 affixed to one of the faces of the support block 108 adjacent one of the ends of the support block 108. Fastener 114 further includes an upper portion 118 connected to the base 116 by a perpendicular support 120. Upper portion 118 extends parallel to base 116 and includes a contoured portion 122 and a head portion 124. Contoured portion 122 contains a contoured upper surface to facilitate snapping the fastener 114 to one of the tilt lock arms 102, as described below. The head portion includes an L-shaped latch 126 with a tapered end to assist in snapping the latch 126 over one of the lock arms 102.

To provide the swivel bracket 30 with additional support, an user inserts the support block 108 through the grooves 106 of the lever 100. An end of the support block that is opposite to the end with the fastener 114 is inserted through both of the elongated grooves 106 of the tilt lock lever 100 until the head portion 124 of the fastener 114 abuts one of the tilt lock arms 102. While simultaneously squeezing the contoured portion 120 towards the base 116 of the fastener 114, the support block 108 is inserted farther through the elongated grooves 106 so that the head portion 124 snaps into place over the arm 102. The inner portion of the latch 126 and the base 116 abut the arm 102 on opposite sides, preventing the support block 108 from moving in a transverse direction relative to the tilt lock lever 100.

The operation of the improved tilt locking assembly of the present invention will now be described. When the swivel bracket 30 and outboard motor 10 are tilted to a desired tilted-up position, the swivel bracket 30 and motor 10 rotate about the primary tilt shaft 32 through swivel bracket arm 36 and about the secondary tilt shaft 34 through tilt lock lever 100. Because shaft 104 and swivel bracket 30 are slidably disposed within the elongated grooves 106 of tilt lock lever 100, the shaft 104 slides within the elongated groove 106 of the lever 100 as the swivel bracket 30 rotates about tilt shafts 32 and 34. This sliding movement allows the swivel bracket 30 and motor 10 to freely rotate to an uppermost tilted-up position without being restrained by the tilt lock lever 100.

As the swivel bracket 30 and motor 10 are raised to a desired tilted-up position, the holder arm 80 is urged against the notched portions 90–94 to facilitate engagement of the holder arm 80 with the notched portions 90–94. The swivel bracket 30 and motor 10 are raised to a position slightly higher than the desired tilted-up position so that the horizontal segments 88 of the holder arm 80 are slightly above the desired notched portions 90–94, the support block 108 is inserted through the grooves 106 of the lever 100 in the manner described above and the swivel bracket 30 is lowered slightly so that the horizontal segments 88 of the holder arm 80 engage one of the notched portions 90–94. The shaft 104 and swivel bracket 30 slide longitudinally within the elongated grooves 106 of the tilt lock lever 100 until the swivel bracket 30 is supported by the support block 108 at contact points 128 where the swivel bracket 30 rests on the support block 108.

Thus, the improved tilt locking assembly of the present invention provides additional support for distributing the load carried by the swivel bracket 30, holder arm 80 and notches 90–94. If the holder arm 80 accidentally disengages the notches 90–94 or if part of the structure of the tilting assembly fails, the additional support means keeps the swivel bracket 30 and outboard motor 10 in a tilted-up and locked position.

Of course, the foregoing description is that of preferred embodiments of the invention, and various changes and modifications may be made without departing from the spirit and scope of the invention, as defined by the appended claims.

What is claimed is:

1. A tilting assembly for an outboard drive unit comprising a clamp bracket having a support portion, said clamp bracket adapted to be affixed to the transom of an associated watercraft, an outboard drive bracket pivotally mounted to said clamp bracket for tilting movement between a desired tilted-down and a tilted-up position, first means for supporting said outboard drive bracket and drive unit in said desired tilted-up position in said support portion of said clamp bracket, said first supporting means pivotally mounted to said outboard drive bracket and selectively engageable with said support portion for setting said desired tilted-up position, and second means for supporting said outboard drive bracket and outboard drive unit in said desired tilted-up position.

2. The tilting assembly of claim 1, wherein said second supporting means comprises a support link pivotally mounted at one end to said clamp bracket and pivotally mounted at an opposite end to said outboard drive bracket.

3. The tilting assembly of claim 2, wherein said support link includes an elongated groove, said outboard drive bracket slidably disposed within said elongated groove for movement in a longitudinal direction relative to said support link.

4. The tilting assembly of claim 3, wherein said support link includes a support block slidably disposed within said elongated groove.

5. A tilting assembly for an outboard drive unit comprising a clamp bracket having a holder portion, said clamp bracket adapted to be affixed to a transom of an associated watercraft, a swivel bracket adapted to be connected to said outboard drive unit for supporting said drive unit, said swivel bracket pivotally mounted to said clamp bracket for tilting movement between a desired tilted-down and a tilted-up position, means for supporting said swivel bracket and drive unit in said desired tilted-up position in said holder portion of said clamp bracket, said supporting means pivotally mounted to said swivel bracket and selectable engageable with said holder portion for setting said desired tilted-up position, a tilt lock lever pivotally mounted at one end to said clamp bracket and pivotally mounted at an opposite end to said swivel bracket, said tilt lock lever having two parallel tilt lock arms with respective aligned elongated grooves, said swivel bracket slidably disposed within said elongated grooves for movement in a longitudinal direction relative to said tilt lock lever, and said tilt lock lever including a support block extending transversely between said tilt lock arms, said support block slidably disposed between said grooves.

6. The tilting assembly of claim 5, wherein said support block includes opposite faces, ends and sides, said support block restrained within said elongated grooves in a direction perpendicular to said faces, said support block longitudinally restrained at one side of said support block by said elongated groove.

7. The tilting assembly of claim 6, wherein said support block is transversely restrained by a fastener connecting said support block to one of said lock arms.

8. The tilting assembly of claim 7, wherein said fastener includes a base affixed to one of said faces of said support block, said fastener further includes an upper portion connected to said base by a support, said upper portion including a latch for engaging said lock arm.

9. A tilting assembly for an outboard drive unit comprising a clamp bracket having a support portion, said clamp bracket adapted to be affixed to a transom of an associated watercraft, an outboard drive bracket pivotally mounted to said clamp bracket for tilting movement between a desired tilted-down and a tilted-up position, a first support which supports said outboard drive bracket in said desired tilted-up position in said support portion of said clamp bracket, said first support pivotally mounted to said outboard drive bracket and selectively engageable with said support portion for setting said desired tilted-up position, and a tilt lock mechanism which additionally supports said outboard drive bracket comprising a support link pivotally mounted at one end to said clamp bracket and pivotally mounted at an opposite end to said outboard drive bracket, said support link including an elongated groove, said outboard drive bracket being slidably disposed with said elongated groove for movement in a longitudinal direction relative to said support link.

10. The tilting assembly of claim 9, wherein said tilt lock mechanism includes a support block disposed within said elongated groove.

* * * * *